US006726453B1

(12) United States Patent
Hsieh

(10) Patent No.: US 6,726,453 B1
(45) Date of Patent: Apr. 27, 2004

(54) QUICK-RELEASE FAN BLADE MOUNTING STRUCTURE FOR CEILING FAN

(76) Inventor: Frank Hsieh, No. 103, Feng Rd., Sheng Kang Hsiang, Taichung Hsien (TW)

( * ) Notice: Subject to any disclaimer, the term of this patent is extended or adjusted under 35 U.S.C. 154(b) by 0 days.

(21) Appl. No.: 10/298,037

(22) Filed: Nov. 14, 2002

(51) Int. Cl.[7] ..... F04D 29/34
(52) U.S. Cl. ..... 416/206; 416/207; 416/210 R
(58) Field of Search ..... 416/204 R, 206, 416/207, 210 R, 244 R; 403/326, 327, 328, 329, 9

(56) References Cited

U.S. PATENT DOCUMENTS 5,980,353 A * 11/1999 Wu ..... 416/210 R
5,980,541 A * 11/1999 Tenzer ..... 606/161
6,059,531 A * 5/2000 Tai ..... 416/220 A
6,378,824 B1 * 4/2002 Tseng ..... 248/220.21

* cited by examiner

*Primary Examiner*—Ninh H. Nguyen

(57) ABSTRACT

A fan blade mounting structure is constructed to include a first coupling unit fixedly located on the rotor of a fan motor assembly, the first coupling unit having a spring-supported hook and a control rod adapted to move the hook between the locking position and the unlocking position, and a second coupling unit fixedly located on a fan blade and adapted to secure the fan blade to the first coupling unit, the second coupling unit having a receiving hole for receiving the first coupling unit, a hook hole for receiving the hook when the hook moved to the locking position, and a spring-supported slide adapted to force the first coupling unit out of the second coupling unit when the hook moved to the unlocking position.

12 Claims, 5 Drawing Sheets

QUICK-RELEASE FAN BLADE MOUNTING STRUCTURE FOR CEILING FAN

BACKGROUND OF THE INVENTION

1. Field of the Invention

The present invention relates to a ceiling fan and, more particularly, to a quick-release fan blade mounting structure for ceiling fan.

2. Description of the Related Art

According to conventional ceiling fan designs, fan blades are commonly fastened to the rotor of the fan motor assembly by screws. This fan blade mounting procedure takes much time and labor. Further, the screws tend to be lost when the fan blades disconnected from the fan motor assembly for storage or delivery.

SUMMARY OF THE INVENTION

The present invention has been accomplished to eliminate the aforesaid drawbacks. It is the one object of the present invention to provide a fan blade mounting structure for ceiling fan, which enables the fan bald to be quickly and detachably fastened to the rotor of the fan motor assembly. It is another object of the present invention of the present invention to provide a fan blade mounting structure for ceiling fan, which enables the consumers to quickly and detachably install the fan blade without tools. According to one aspect of the present invention, the fan blade mounting structure comprises a first coupling unit fixedly located on the rotor of a fan motor assembly, and a second coupling unit fixedly fastened to a fan blade and adapted to secure the fan blade to the first coupling unit. The first coupling unit comprises a spring-supported hook, and a control rod adapted to move the hook between the locking position and the unlocking position. The second coupling unit has a receiving hole for receiving the first coupling unit, a hook hole for receiving the hook when the hook moved to the locking position, and a spring-supported slide adapted to force the first coupling unit out of the second coupling unit when the hook moved to the unlocking position. According to another aspect of the present invention, the second coupling unit has parallel guide grooves adapted to guide movement of the slide.

DETAILED DESCRIPTION OF THE PREFERRED EMBODIMENT

Figure 1:
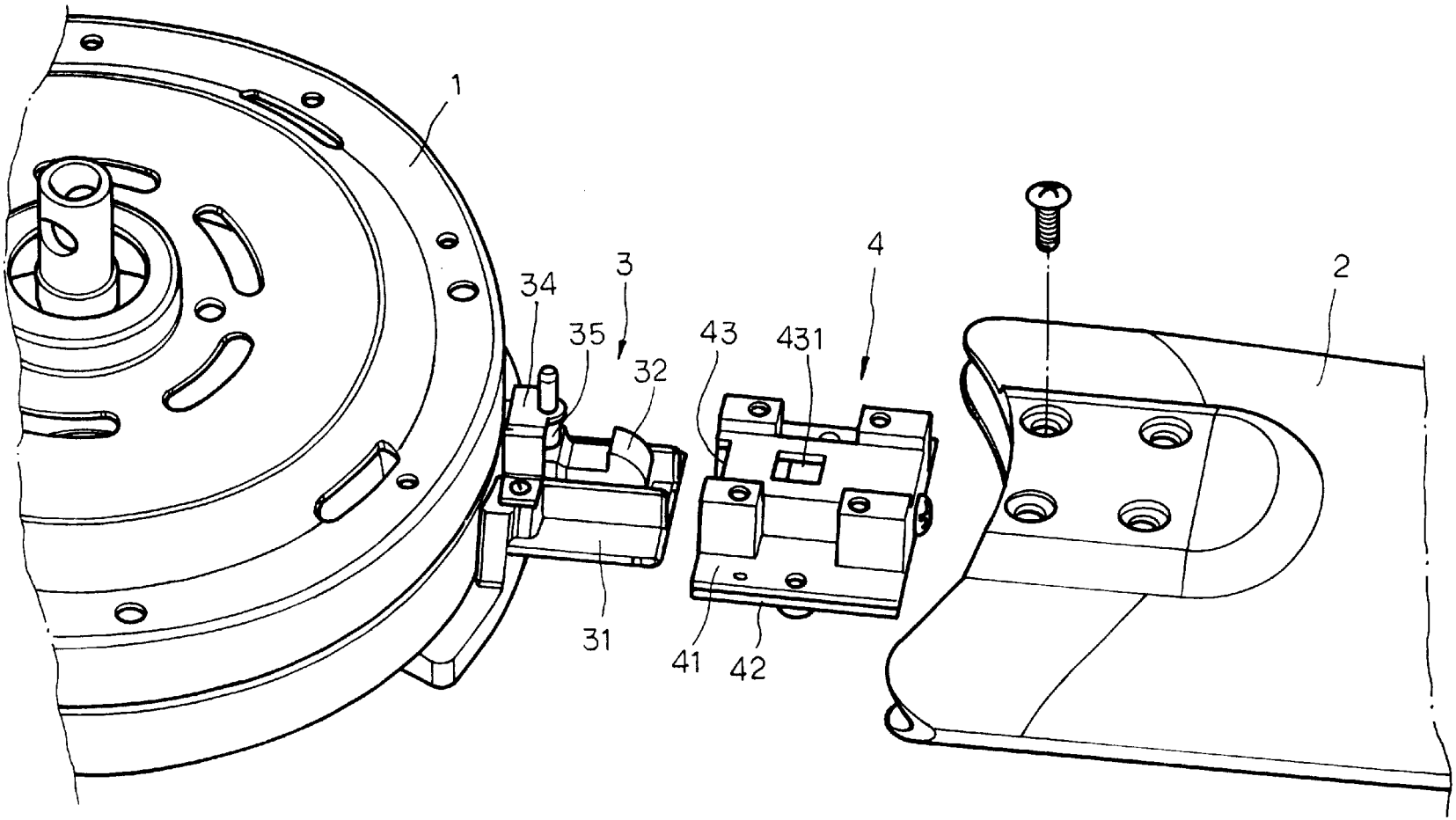
FIG. 1 is a perspective view of a quick-release fan blade mounting structure for ceiling fan according to the present invention.

Referring to FIG. 1, a quick-release fan blade mounting structure for ceiling fan in accordance with the present invention is shown comprising a fan motor assembly 1, a fan blade2, a first coupling unit 3, a second coupling unit 4.

Figure 2:
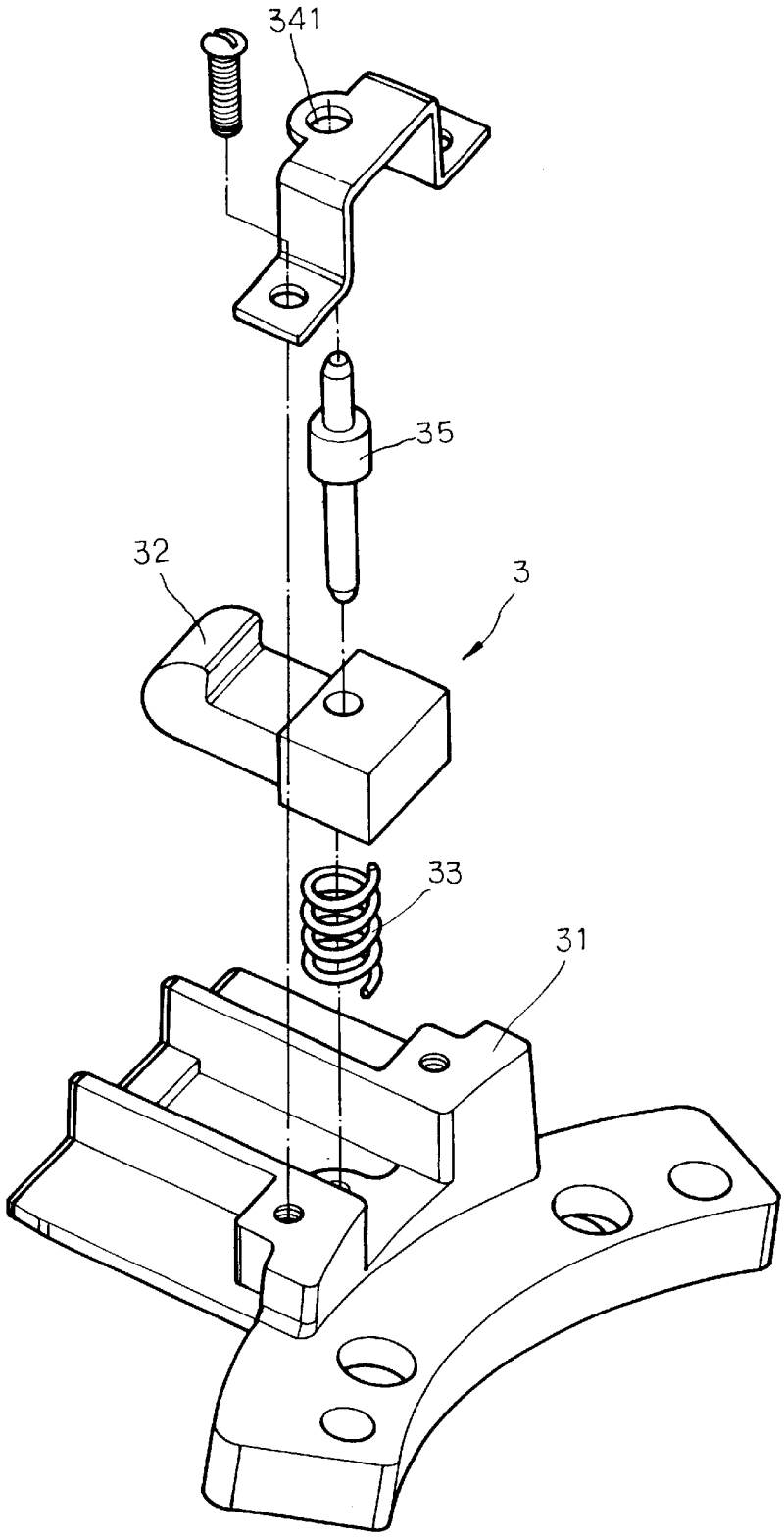
FIG. 2 is an exploded view in an enlarged scale of the first coupling unit of the fan blade mounting structure according shown in FIG. 1.
Figure 5:
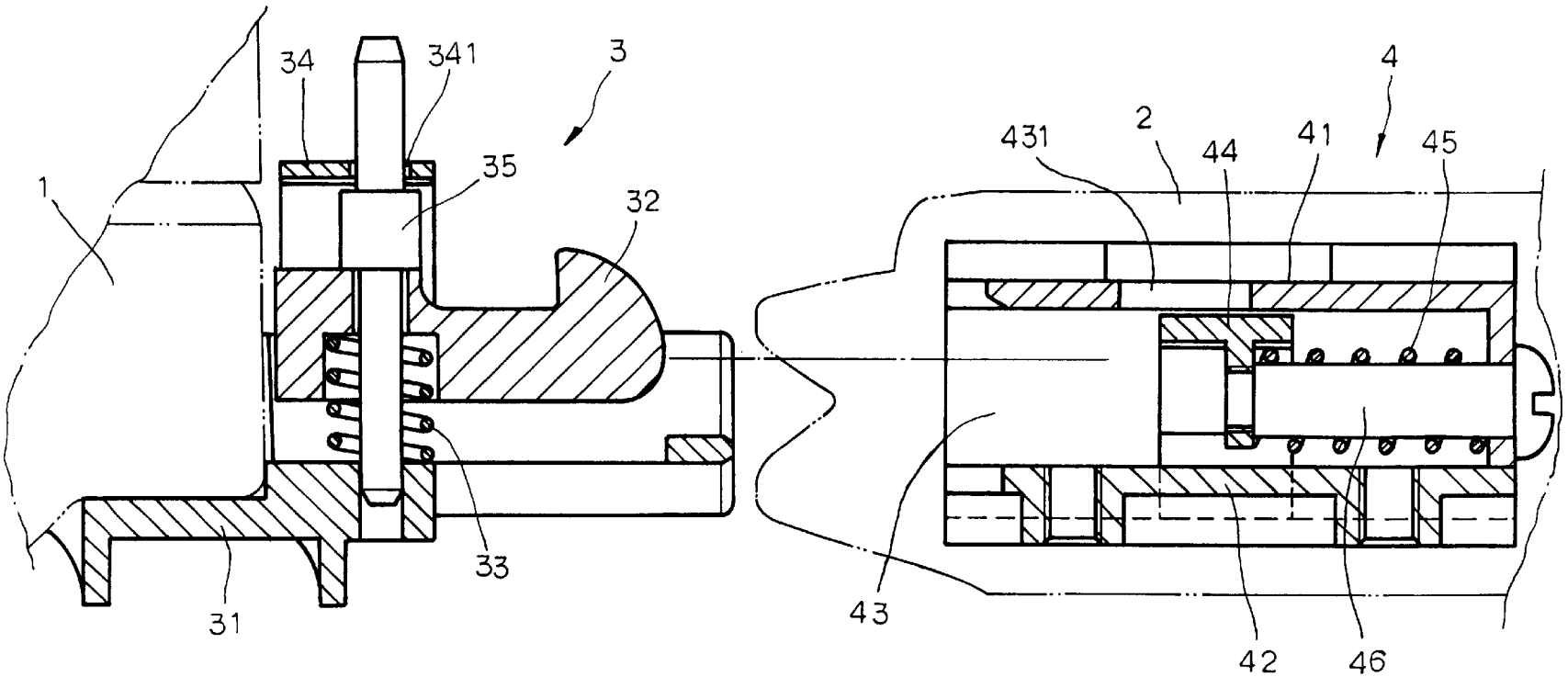
FIG. 5 is similar to FIG. 4 but showing the fan blade disconnected with the second coupling unit from the first coupling unit at the fan hub.

Referring to FIGS. 2 and 5, the first coupling unit 3 comprises a holder base 31 fixedly fastened to the rotor of the fan motor assembly 1, a hook 32 fastened pivotally with the holder base 31, a spring member, for example, a compression spring 33 supported between the holder base 31 and the hook 32, a guide plate 34 fixedly fastened to the holder base 31 and bridging the hook 32, the guide plate 34 having a guide hole 341, and a control rod 35 mounted in the guide hole 341 and pivoting the hook 32 to the holder base 31. Normally, the compression spring 33 imparts an upward pressure to the hook 32, thereby causing the hook 32 to press the expanded flank of the control rod 35 against the bottom sidewall of the guide plate 34.

Figure 3:
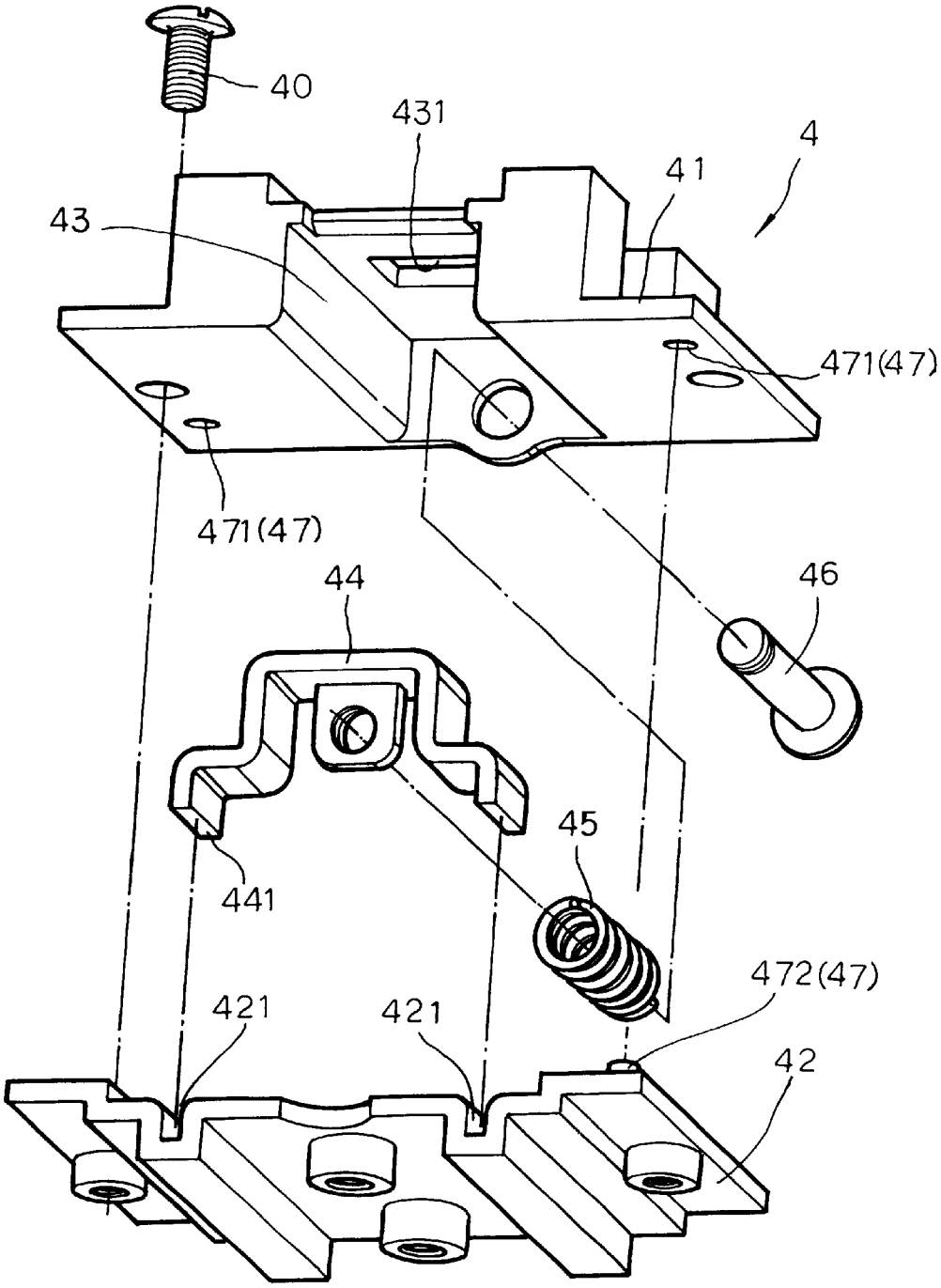
FIG. 3 is an exploded view in an enlarged scale of the second coupling unit of the fan blade mounting structure shown in FIG. 1.

Referring to FIG. 3 and FIG. 5 again, the second coupling unit 4 is fixedly fastened to the fan blade 2, comprising a top cover plate 41, a bottom cover plate 42, a slide 44, a spring member, for example, a compression spring 45, and a guide bolt 46. The top cover plate 41 and the bottom cover plate 42 are secured together and fixedly fastened to the fan blade 2 by screws 40. The top cover plate 41 has a forwardly extended bottom receiving chamber 43, and a top hook hole 431 in communication with the bottom receiving chamber 43. The bottom cover plate 42 has two parallel sliding grooves 421 longitudinally arranged in the top sidewall thereof. The slide 44 is provided in the bottom receiving chamber 43 of the top cover plate 41, having two bottom rails 441 respectively coupled to the sliding grooves 421 of the bottom cover plate 42. The sliding grooves 421 guide stable movement of the slide 44 in between the cover plates 41 and 42. The second coupling unit 4 further comprises positioning means 47. The positioning means 47 comprises a plurality of positioning holes 471 bilaterally formed in the bottom sidewall of the top cover plate 41, and a plurality of positioning rods 472 bilaterally formed integral with the top sidewall of the bottom cover plate 42 and respectively fitted into the positioning holes 471 in the top cover plate 41.

Figure 4:
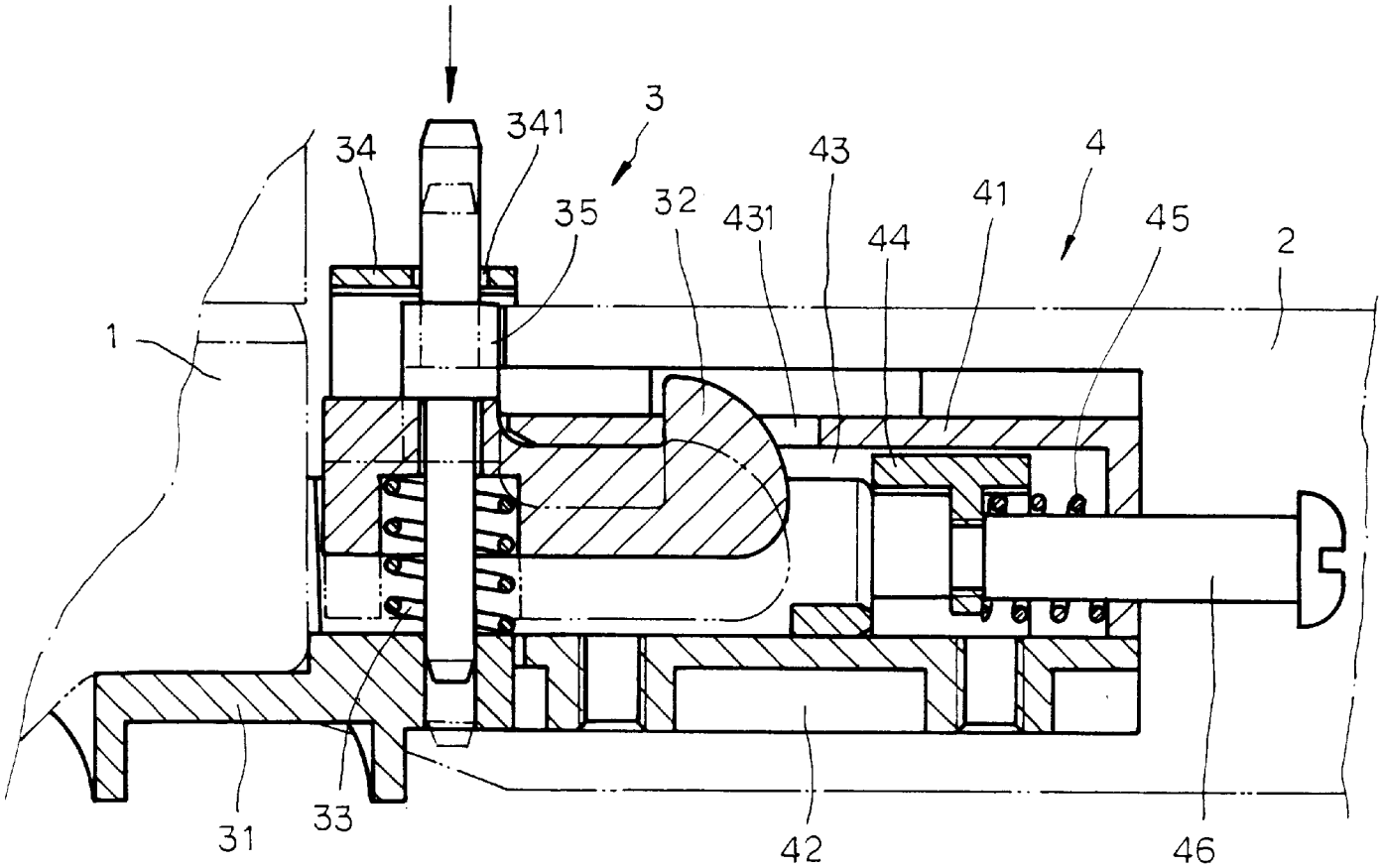
FIG. 4 is a schematic sectional view showing the second coupling unit with the fan blade fastened to the first coupling unit at the fan hub according to the present invention.

Referring to FIG. 4 and FIG. 1 again, when fastening the fan blade 2 to the rotor of the fan motor assembly 1, press the control rod 35 to lower the hook 32 against the compression spring 33, and then insert the holder base 31 into the bottom receiving chamber 43 of the top cover plate 41 to push the slide 44 backwards along the sliding grooves 421 against the compression spring 45 to open the hook hole 431, for enabling the hook 32 to be forced by the compression spring 33 to hook the hook hole 431 and to secure the second coupling unit 4 to the first coupling unit 3, and therefore the fan blade 2 is fastened to the rotor of the fan motor assembly 1.

Referring to FIGS. 1 and 5 again, when disconnecting the fan blade 2 from the rotor of the fan motor assembly 1, press the control rod 35 to disengage the hook 32 from the hook hole 431. At this time, the compression spring 45 imparts a forward pressure to the slide 44 against the holder base 31 to force the second coupling unit 4 away from the first coupling unit 3, and therefore the fan blade 2 is disconnected from the fan motor assembly 1.

A prototype of fan blade mounting structure for ceiling fan has been constructed with the features of FIGS. 1~5. The fan blade mounting structure for ceiling fan functions smoothly to provide all of the features discussed earlier.

Although a particular embodiment of the invention has been described in detail for purposes of illustration, various modifications and enhancements may be made without departing from the spirit and scope of the invention. For example, the first coupling unit 3 can be installed in the fan blade 2, and the second coupling unit 4 can be installed in the rotor of the fan motor assembly 1 for receiving the first coupling unit 3. Accordingly, the invention is not to be limited except as by the appended claims.

What the invention claimed is:

1. A fan blade mounting structure provided between the rotor of a fan motor assembly and a fan blade for enabling said fan blade to be detachably fastened to the rotor of said fan motor, the fan blade mounting structure comprising:

a first coupling unit positioned on one of the fan motor assembly and a fan blade, said first coupling unit comprising a holder base, a hook fastened pivotally with said holder base, and a control rod adapted to move said hook between a locking position and an unlocking position; and a second coupling unit adapted to receive said first coupling unit, said second coupling unit comprising a receiving chamber adapted to receive said holder base of said first coupling unit, a hook hole disposed in communication with said receiving chamber and adapted to receive said hook when said hook moved to said locking position, a slide movable in said receiving chamber, and a spring member adapted to support said slide and to force said slide to push said first holder base of said first coupling unit out of said first receiving chamber when said hook moved from said locking position to said unlocking position.

2. The fan blade mounting structure as claimed in claim 1, wherein said first coupling unit further comprises a compression spring provided between said holder base and said hook to support said hook in said locking position.

3. The fan blade mounting structure as claimed in claim 1, wherein said first coupling unit further comprises a guide plate fixedly fastened to said holder base and spaced above said hook, said guide plate having a guide hole, which receives said control rod to guide movement of said control rod.

4. The fan blade mounting structure as claimed in claim 1, wherein said second coupling unit further comprises a guide bolt inserted through the compression spring of said second coupling unit and adapted to guide movement of said slide in said receiving chamber.

5. The fan blade mounting structure as claimed in claim 1, wherein the spring member of said second coupling unit is a compression spring.

6. The fan blade mounting structure as claimed in claim 1, wherein said second coupling unit comprises a bottom cover plate, which supports said slide, and a top cover plate covered on said bottom cover plate, said top cover plate defining said receiving chamber and said hook hole.

7. The fan blade mounting structure as claimed in claim 6, wherein said second coupling unit further comprises positioning means adapted to secure said bottom cover plate and said top cover plate together.

8. The fan blade mounting structure as claimed in claim 7, wherein said positioning means comprises a plurality of positioning holes respectively formed in a bottom sidewall of said top cover plate, and a plurality of positioning rods respectively formed in a top sidewall of said bottom cover plate for fitting into said positioning holes.

9. The fan blade mounting structure as claimed in claim 7, wherein said second coupling unit comprises a bottom cover plate, which supports said slide, and a top cover plate covered on said bottom cover plate; said slide of said second coupling unit is movable in between said bottom cover plate and said top cover plate.

10. The fan blade mounting structure as claimed in claim 9, wherein said bottom cover plate has two longitudinal sliding grooves in a top sidewall thereof, and said slide has two bottom rails respectively coupled to the sliding grooves of said bottom cover plate to guide movement of said slide in said receiving chamber.

11. The fan blade mounting structure as claimed in claim 1, wherein said first coupling unit is fixedly fastened to the rotor of said fan motor assembly, and said second coupling unit is fixedly fastened to said fan blade.

12. The fan blade mounting structure as claimed in claim 1, wherein said first coupling unit is fixedly fastened to said fan blade, and said second coupling unit is fixedly fastened to the rotor of said fan motor assembly.

* * * * *